US008528741B2

(12) United States Patent
Asada

(10) Patent No.: US 8,528,741 B2
(45) Date of Patent: Sep. 10, 2013

(54) PAPER SHEET COUNTING SYSTEM AND PAPER SHEET COUNTING METHOD

(75) Inventor: Toshihide Asada, Yokohama (JP)

(73) Assignee: GLory Ltd., Himeji-Shi, Hyogo-Ken (JP)

( * ) Notice: Subject to any disclaimer, the term of this patent is extended or adjusted under 35 U.S.C. 154(b) by 113 days.

(21) Appl. No.: 12/932,292

(22) Filed: Feb. 23, 2011

(65) Prior Publication Data

US 2012/0211405 A1 Aug. 23, 2012

(51) Int. Cl.
*B07C 5/00* (2006.01)

(52) U.S. Cl.
USPC ..... 209/509; 209/552; 209/584; 209/900

(58) Field of Classification Search
USPC ..... 209/509, 534, 551, 552, 583, 900
See application file for complete search history.

(56) References Cited

U.S. PATENT DOCUMENTS

2011/0004337 A1* 1/2011 Doi ..... 700/223
2011/0206265 A1* 8/2011 Numata et al. ..... 382/135
2011/0304091 A1* 12/2011 Hirano et al. ..... 271/3.14

* cited by examiner

*Primary Examiner* — Terrell Matthews
(74) *Attorney, Agent, or Firm* — Renner, Kenner, Greive, Bobak, Taylor & Weber

(57) ABSTRACT

A paper sheet counting system includes: a first paper sheet counting apparatus whose operation mode can be switched between a cooperative mode and an independent mode, the first paper sheet counting apparatus including: a first receiving unit configured to take in deposited paper sheets one by one; at least two first stacking units configured to stack therein the paper sheets; a first recognition unit configured to recognize and count the paper sheets; and a first transport unit configured to transport the paper sheets between the first receiving unit and the first stacking units, based on a recognition result of the first recognition unit; a second paper sheet counting apparatus whose operation mode can be switched between a cooperative mode and an independent mode, the second paper sheet counting apparatus being capable of communicating with the first paper sheet counting apparatus, the second paper sheet counting apparatus including: a second receiving unit configured to take in deposited paper sheets one by one; at least one second stacking unit configured to stack therein the paper sheets; a second recognition unit configured to recognize and count the paper sheets; and a second transport unit configured to transport the paper sheets between the second receiving unit and the second stacking unit, based on a recognition result of the second recognition unit; and a tallying unit configured to acquire count results from the first recognition unit and the second recognition unit and to tally the count results, when the first paper sheet recognition unit and the second paper sheet recognition unit are in the cooperative modes.

12 Claims, 7 Drawing Sheets

PAPER SHEET COUNTING SYSTEM AND PAPER SHEET COUNTING METHOD

FIELD OF THE INVENTION

The present invention relates to a paper sheet counting system and a paper sheet counting method, which can count paper sheets, such as banknotes and checks, by a plurality of paper sheet counting apparatuses that cooperate with each other.

BACKGROUND OF THE INVENTION

Various types of apparatuses have been conventionally used as an apparatus for counting paper sheets such as banknotes and checks. For example, US2003/0062242A discloses a currency handling system which includes a large-sized first currency handling apparatus having a plurality of output receptacles, and a small-sized second currency handling apparatus that is telecommunicated to the first currency handling apparatus, and has at least one output receptacle. In this currency handling system, currencies that could not be sorted by the large-sized first currency handling apparatus are sorted by the small-sized second currency handling system.

However, such a conventional system is disadvantageous in that the cost is high because of the use of the large-sized currency handling apparatus. In addition, in this system, since the one large-sized currency handling apparatus and the one small-sized currency handling apparatus merely cooperate with each other, the structure of the system cannot be changed depending on objects to be sorted. Namely, the system lacks in flexibility and scalability.

SUMMARY OF THE INVENTION

The paper sheet counting system in one embodiment of the present invention is a paper sheet counting system including: a first paper sheet counting apparatus whose operation mode can be switched between a cooperative mode and an independent mode, the first paper sheet counting apparatus including: a first receiving unit configured to take in deposited paper sheets one by one; at least two first stacking units configured to stack therein the paper sheets; a first recognition unit configured to recognize and count the paper sheets; and a first transport unit configured to transport the paper sheets between the first receiving unit and the first stacking units, based on a recognition result of the first recognition unit; a second paper sheet counting apparatus whose operation mode can be switched between a cooperative mode and an independent mode, the second paper sheet counting apparatus being capable of communicating with the first paper sheet counting apparatus, the second paper sheet counting apparatus including: a second receiving unit configured to take in deposited paper sheets one by one; at least one second stacking unit configured to stack therein the paper sheets; a second recognition unit configured to recognize and count the paper sheets; and a second transport unit configured to transport the paper sheets between the second receiving unit and the second stacking unit, based on a recognition result of the second recognition unit; and a tallying unit configured to acquire count results from the first recognition unit and the second recognition unit and to tally the count results, when the first paper sheet recognition unit and the second paper sheet recognition unit are in the cooperative modes.

The paper sheet counting system in another embodiment of the present invention is a paper sheet counting system including: a first paper sheet counting apparatus whose operation mode can be switched between a cooperative mode and an independent mode, the first paper sheet counting apparatus including: a first receiving unit configured to take in deposited paper sheets one by one; at least two first stacking units configured to stack therein the paper sheets; a first recognition unit configured to recognize and count the paper sheets; and a first transport unit configured to transport and sort the paper sheets taken in by the first receiving unit into the respective stacking units, based on a recognition result of the first recognition unit and a first sorting criterion; and a second paper sheet counting apparatus whose operation mode can be switched between a cooperative mode and an independent mode, the second paper sheet counting apparatus being capable of communicating with the first paper sheet counting apparatus, the second paper sheet counting apparatus including: a second receiving unit configured to take in deposited paper sheets one by one; at least one second stacking unit configured to stack therein the paper sheets; a second recognition unit configured to recognize and count the paper sheets; and a second transport unit configured to transport the paper sheets taken in by the second receiving unit to the second stacking unit, based on a recognition result of the second recognition unit and a second sorting criterion; wherein, when the first paper sheet counting apparatus and the second paper sheet counting apparatus are in the cooperative modes, the first sorting criterion and the second sorting criterion are criteria for sorting the paper sheets of different kinds, belonging to a same category.

The paper sheet counting method in one embodiment of the present invention is a paper sheet counting method using: a first paper sheet counting apparatus whose operation mode can be switched between a cooperative mode and an independent mode, the first paper sheet counting apparatus including: a first receiving unit configured to take in deposited paper sheets one by one; at least two first stacking units configured to stack therein the paper sheets; a first recognition unit configured to recognize and count the paper sheets; and a first transport unit configured to transport the paper sheets between the first receiving unit and the first stacking units, based on a recognition result of the first recognition unit; and a second paper sheet counting apparatus whose operation mode can be switched between a cooperative mode and an independent mode, the second paper sheet counting apparatus being capable of communicating with the first paper sheet counting apparatus, the second paper sheet counting apparatus including: a second receiving unit configured to take in deposited paper sheets one by one; at least one second stacking unit configured to stack therein the paper sheets; a second recognition unit configured to recognize and count the paper sheets; and a second transport unit configured to transport the paper sheets between the second receiving unit and the second stacking unit, based on a recognition result of the second recognition unit; wherein, when the first paper sheet counting apparatus and the second paper sheet counting apparatus are in the cooperative modes, the first paper sheet counting apparatus and the second paper sheet counting apparatus operate cooperatively with each other.

DESCRIPTION OF THE EMBODIMENTS

Embodiments of the present invention will be described herebelow with reference to the drawings.

Figure 1:
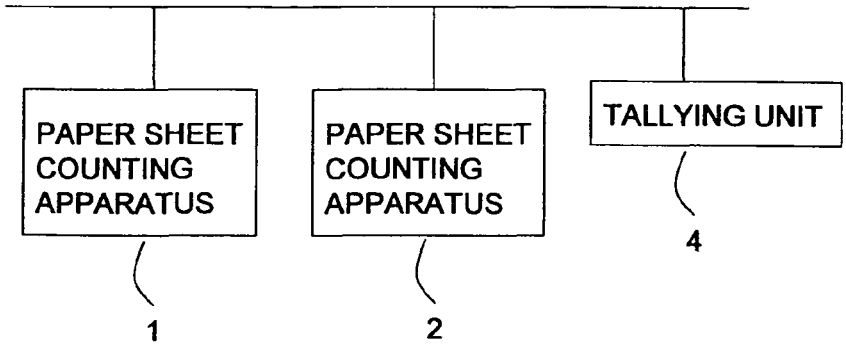
FIG. 1 is a view showing a block structure of a paper sheet counting system in one embodiment of the present invention.

FIG. 1 shows a block structure of a paper sheet counting system in one embodiment of the present invention. The paper sheet counting system is composed of a paper sheet counting apparatus 1, a paper sheet counting apparatus 2, and a tallying unit 4. The paper sheet counting apparatuses 1 and 2 are configured to recognize and count paper sheets. The tallying unit 4 is configured to tally count results by the paper sheet counting apparatus 1 and the paper sheet counting apparatus 2. The paper sheet counting apparatus 1, the paper sheet counting apparatus 2 and the tallying unit 4 are connected to each other by LAN or the like.

Each of the paper sheet counting apparatus 1 and the paper sheet counting apparatus 2 has two switchable operation modes, i.e., an independent mode and a cooperative mode. In the cooperative mode, the paper sheet counting apparatus 1 is capable of communicating data among itself and the paper sheet counting apparatus 2 and the tallying unit 4. On the other hand, in the independent mode, the paper sheet counting apparatus 1 does not communicate data between itself and the paper sheet counting apparatus 2 and the tallying unit 4. In other words, in the independent mode, the paper sheet counting apparatus 1 turns off the communication function among itself and the paper sheet counting apparatus 2 and the tallying unit 4.

Similarly, in the cooperative mode, the paper sheet counting apparatus 2 is capable of communicating data among itself and the paper sheet counting apparatus 1 and the tallying unit 4. On the other hand, in the independent mode, the paper sheet counting apparatus 2 does not communicate data among itself and the paper sheet counting apparatus 1 and the tallying unit 4. In other words, in the independent mode, the paper sheet counting apparatus 2 turns off the communication function among itself and the paper sheet counting apparatus 1 and the tallying unit 4.

When the paper sheet counting apparatus 1 and the paper sheet counting apparatus 2 are in the cooperative modes, the paper sheet counting apparatuses 1 and 2 count and sort paper sheets cooperatively with each other. At this time, the tallying unit 4 acquires count results from the paper sheet counting apparatus 1 and the paper sheet counting apparatus 2, and tallies the count results.

In the independent modes, the paper sheet counting apparatus 1 and the paper sheet counting apparatus 2 do not cooperate with each other, but count and sort paper sheets independently of each other.

The paper sheet counting apparatus 1 is an apparatus including two or more stacking units in which paper sheets recognized and counted by the paper sheet counting apparatus 1 are stacked. On the other hand, the paper sheet counting apparatus 2 is an apparatus including one or more stacking unit(s) in which paper sheets recognized and counted by the paper sheet counting apparatus 2 are stacked.

Figure 2:
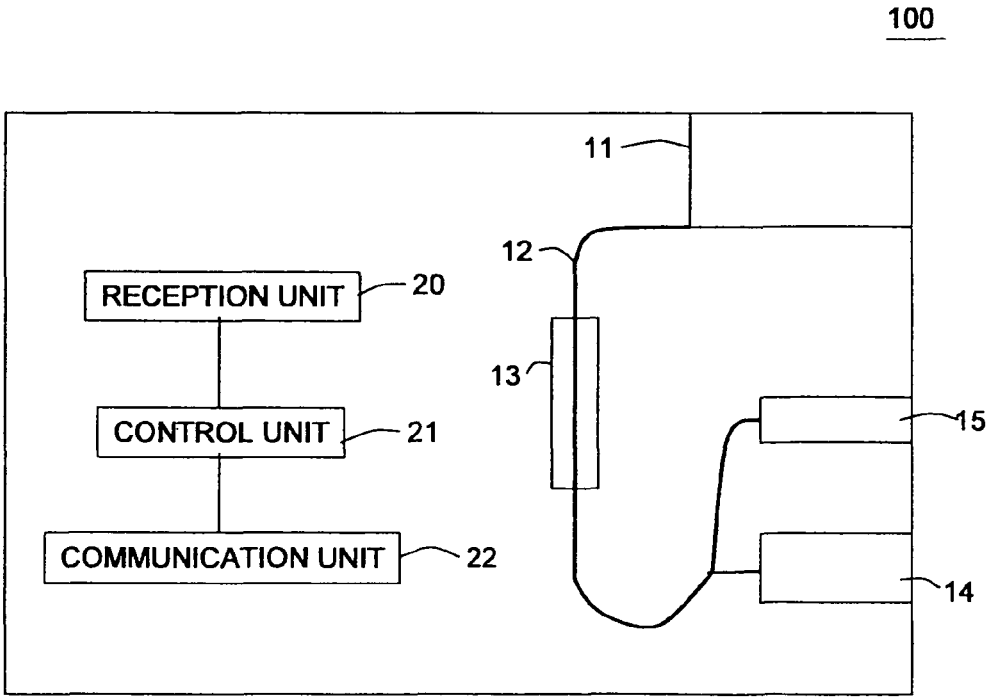
FIG. 2 is a view showing a structural example of a paper sheet counting apparatus including two stacking units.

FIG. 2 shows a structural example of a paper sheet counting apparatus including two stacking units. As shown in FIG. 2, a paper sheet counting apparatus 100 includes a receiving unit 11 configure to take in paper sheets one by one into the apparatus, and a transport unit 12 configured to transport the paper sheets taken in by the receiving unit 11 one by one. The receiving unit 11 receives paper sheets deposited by an operator, and takes in the paper sheets one by one into the apparatus. The transport unit 12 transports the paper sheets to a stacking unit 14 or a reject unit 15. The stacking unit 14 and the reject unit 15 correspond to the two stacking units. The transport unit 12 is formed by, for example, combining belt transport mechanisms. The belt transport mechanism includes, for example, a pair of rollers or three or more rollers, and rubber belts fitted around the respective rollers.

The transport unit 12 is provided with a recognition unit 13 configured to recognize and count the paper sheets taken in by the receiving unit 11. The recognition unit 13 is formed of, e.g., a line sensor. The transport unit 12 is diverged into two transport paths at a position downstream of the recognition unit 13. The stacking unit 14 is connected to one of the transport paths, and the reject unit 15 is connected to the other transport path.

As shown in FIG. 2, the paper sheet counting apparatus 100 is equipped with a reception unit 20 configured to receive a command for switching the operation modes from an operator, a control unit 21 configured to control the respective units of the paper sheet counting apparatus 100, and a communication unit 22 configured to communicate with an external device.

Upon reception of a command for switching the operation modes, the reception unit 20 transmits the contents of the command to the control unit 21. The reception unit 20 is formed of, e.g., a pushable button or a pressable key.

The control unit 21 receives a recognition result of paper sheets from the recognition unit 13, and determines the destinations to which the paper sheets are transported. With the use of a predetermined sorting criterion, the control unit 21 controls the transport unit 12 such that the paper sheets are transported and sorted into the stacking unit 14 or the reject unit 15. For example, a paper sheet meeting the predetermined sorting criterion (corresponding to the predetermined sorting criterion) is transported to the stacking unit 14, and a paper sheet not meeting (not corresponding to) the predetermined sorting criterion is transported to the reject unit 15. An unrecognizable note and a counterfeit note are transported to the reject unit 15.

Various kinds of sorting criteria, such as portrait-up/portrait-down (portrait-upright/portrait-inverted) and face-up/face-down, may be used. Table 1 shows examples of the sorting criteria when pacer sheets are banknotes.

TABLE 1

| Category | Kind |
|---|---|
| Denomination | 100$, 50$, 20$, 10$ . . . |
| Face/Back | Face-up, Face-down |
| Up/Down | Portrait-up, Portrait-down |
| Fitness | ATM Fit, Fit, Unfit |
| Currency | Dollar, Yen, Euro, Yuan . . . |

Herein, a banknote in "ATM Fit" condition is hardly stained or damaged and thus is neater than a banknote in Fit condition, whereby the banknote in ATM Fit can be used to replenish an ATM (Automated Teller Machine). When "Fit" is used as the sorting criterion, a banknote in ATM Fit condition is sorted as a banknote in Fit condition. The reason is to prevent banknote in ATM Fit condition and a banknote in Unfit condition from being mixed in the reject unit 15.

A sorting criterion can be set by kinds belonging to the respective categories. For example, when a sorting criterion is "20$", 20$ banknotes are transported to the stacking unit 14, and other banknotes are transported to the reject unit 15. In addition, when a sorting criterion is Euro, for example, Euro banknotes are transported to the stacking unit 14, and banknotes of other currencies are transported to the reject unit 15.

A plurality of kinds belonging to one category may be set as a sorting criterion. For example, when a sorting criterion are "100$ and 50$", 100$ banknotes and 50$ banknotes are transported to the stacking unit 14, and other banknotes are transported to the reject unit 15.

Further, kinds belonging to different categories may be set as a sorting criterion. For example, when a sorting criterion is "10$ and ATM Fit", 10$ banknotes in ATM Fit condition are transported to the stacking unit 14, and other banknotes are transported to the reject unit 15.

When the operation mode is switched from the independent mode to the cooperative mode, the control unit 21 controls the communication unit 22 such that the communication unit 22 performs a data communication with an external device. Meanwhile, when the operation mode is switched from the cooperative mode to the independent mode, the control unit 21 controls the communication unit 22 such that the communication unit 22 stops the data communication with the external device.

The communication unit 22 communicates with another paper sheet counting apparatus and the tallying unit 4. For example, the communication unit 22 transmits to another paper sheet counting apparatus, a sorting criterion that is used by the control unit 21 to determine the destinations to which the paper sheets are transported. In addition, the communication unit 22 acquires, from the communication unit 22 of another paper sheet counting apparatus, information about a sorting criterion that is set in the other paper sheet counting apparatus. Furthermore, the communication unit 22 transmits a count result to the tallying unit 4, after all the paper sheets have been recognized and counted. As the count result, the communication unit 22 can transmit various information, such as the number of paper sheets that meet/do not meet a sorting criterion, the number of banknotes of each denomination, the number of paper sheets recognized by the recognition unit 13, and so on.

Figure 3:
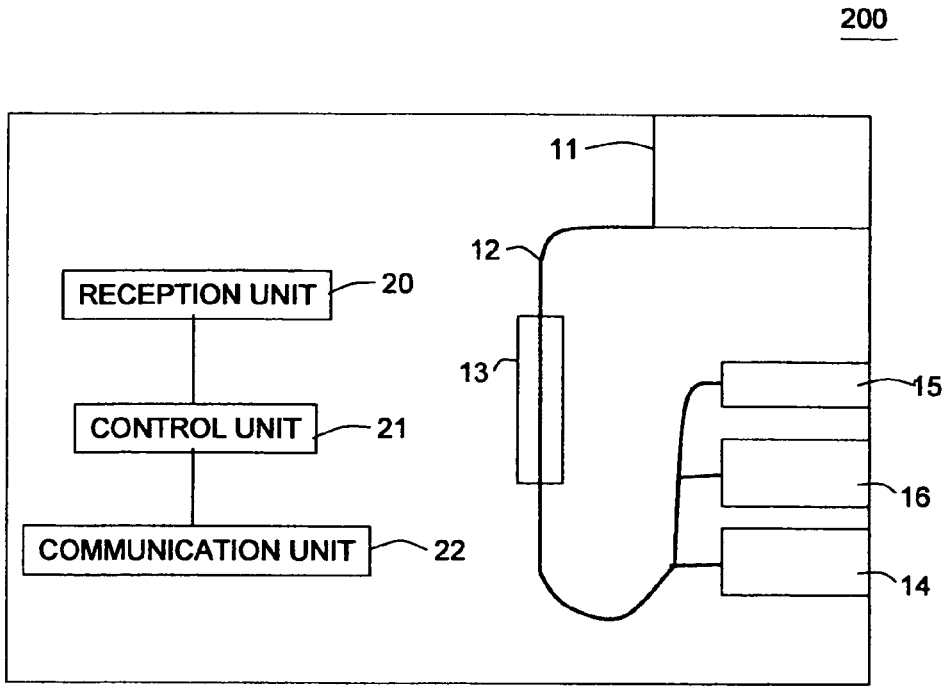
FIG. 3 is a view showing a structural example of the paper sheet counting apparatus including three stacking units.

Next, the structure of a paper sheet counting apparatus including three stacking units is described with reference to FIG. 3. A paper sheet counting apparatus 200 shown in FIG. 3 differs from the paper sheet counting apparatus 100 shown in FIG. 2 in that a stacking unit 16 is provided. In FIG. 3, the same units as those of the paper sheet counting apparatus 100 shown in FIG. 2 are depicted by the same reference numbers, and a detailed description thereof is omitted.

As shown in FIG. 3, a transport unit 12 is diverged into three transport paths at a position downstream of a recognition unit 13. The transport paths are respectively connected to a stacking unit 14, the stacking unit 16 and a reject unit 15.

In this paper sheet counting apparatus 200, since there are three destinations to which paper sheets are transported, the number of sorting criteria can be increased as compared with the paper sheet counting apparatus 100 shown in FIG. 2. For example, when sorting criteria are "100$" and "50$", 100$ banknotes are transported to the stacking unit 14, 50$ banknotes are transported to the stacking unit 16, and other banknotes are transported to the reject unit 15.

Alternatively, when sorting criteria are "10$ and Face-up" and "10$ and Face-down", face-up 10$ banknotes are transported to the stacking unit 14, face-down 10$ banknotes are transported to the stacking unit 15, and other banknotes are transported to the reject unit 15.

Figure 4:
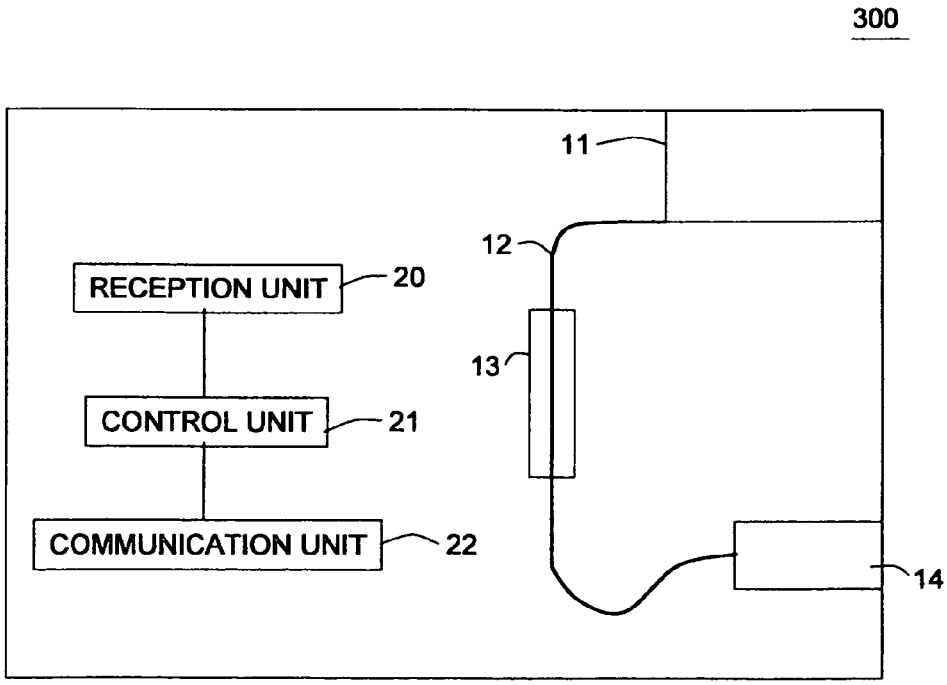
FIG. 4 is a view showing a structural example of the paper sheet counting apparatus including one stacking unit.

Following thereto, the structure of a paper sheet counting apparatus including one stacking unit is described with reference to FIG. 4. A paper sheet counting apparatus 300 shown in FIG. 4 differs from the paper sheet counting apparatus 100 shown in FIG. 2 in that the reject unit 15 is not included. In FIG. 4, the same units as those of the paper sheet counting apparatus 100 shown in FIG. 2 are depicted by the same reference numbers, and a detailed description thereof is omitted.

As shown in FIG. 4, a transport unit 12 transports all the paper sheets recognized and counted by a recognition unit 13 to a stacking unit 14. When a control unit 21 judges, from the recognition result by the recognition unit 13, that a certain paper sheet is a paper sheet that does not meet a predetermined sorting criterion, the control unit 21 controls a receiving unit 11 and the transport unit 12 such that the taking-in of paper sheets and the transporting thereof are stopped, after the certain paper sheet has been transported to the stacking unit 14 and stacked therein. Similarly, when a paper sheet is judged as an unrecognizable note or a counterfeit note, the control unit 21 stops the taking-in of paper sheets and the transporting thereof.

Thus, the operation of the apparatus is stopped, with the certain paper sheet that does not meet the predetermined sorting criterion being on top of the paper sheets stacked in the stacking unit 14. At this time, the control unit 21 may turn on an illumination unit (not shown) or display a notice on a display panel (not shown) so as to notify an operator of the presence of the paper sheet that does not meet the predetermined sorting criterion in the stacking unit 14.

The operator takes out the paper sheet on top of the paper sheets stacked in the stacking unit 14, and gives a command for restarting the operation. Then, the control unit 21 controls the receiving unit 11 and the transport unit 12 such that the taking-in of paper sheets and the transporting thereof are restarted. The restart command from the operator may be received by the reception unit 20. Alternatively, a reception means for receiving a restart command may be additionally provided.

A sorting criterion may be manually set by an operator in the paper sheet counting apparatus, or may be set by a management apparatus such as a personal computer.

In addition, a kind of a paper sheet, which is firstly recognized by the recognition unit 13, may be set as a sorting criterion. In this case, a category is set beforehand. For example, under conditions that the denomination is set as a category, when a paper sheet that is firstly recognized by the recognition unit 13 is a 20$ banknote, a sorting criterion is set as "20$". Alternatively, under conditions that the denomination and the face/back are set as categories, when a paper sheet that is firstly recognized by the recognition unit 13 is a face-up 10$ banknote, a sorting criterion is set as "10$ and Face".

When there are three stacking units, a kind of a paper sheet that is firstly recognized by the recognition unit 13, and a kind of a paper sheet that is secondly recognized by the recognition unit 13 (the kind of the secondly recognized paper sheet is different from that of the firstly recognized paper sheet) may be set as sorting criteria. For example, under conditions that the denomination is set as a category, when a paper sheet that is firstly recognized by the recognition unit 13 is a 10$ banknote and a paper sheet that is secondly recognized by the recognition unit 13 is a 1$ banknote, sorting criteria are set as "10$" and "1$".

Further, a sorting criterion may be set based on a sorting criterion of another paper sheet counting apparatus. For example, it is possible to set a sorting criterion which is different in kind but belonging to the same category as a sorting criterion transmitted from another paper sheet counting apparatus. For example, when a sorting criterion of another paper sheet counting apparatus is "10$", a sorting criterion is set as "20$". Such a method of setting a sorting criterion is advantageous when paper sheets are sorted by one paper sheet counting apparatus, and then paper sheets that do not meet the sorting criterion are further sorted by another paper sheet counting apparatus based on a different sorting criterion.

In addition, it is possible to set a sorting criterion that is the same as a sorting criterion transmitted by another paper sheet counting apparatus. For example, when a sorting criterion of another paper sheet counting apparatus is "Face", a sorting criterion is set as "Face". Such a method of setting a sorting criterion is advantageous when there are a large number of paper sheets to be sorted, and the paper sheets are sorted in parallel with each other by a plurality of paper sheet counting apparatuses.

As described above, in the paper sheet counting system in these embodiments, the paper sheet counting apparatus 1 and the paper sheet counting apparatus 2 are configured to recognize, count and sort paper sheets, and the tallying unit 4 is configured to tally count results. Although the paper sheet counting system shown in FIG. 1 includes the two paper sheet counting apparatuses, the paper sheet counting system may include three or more paper sheet counting apparatuses.

Figure 9:
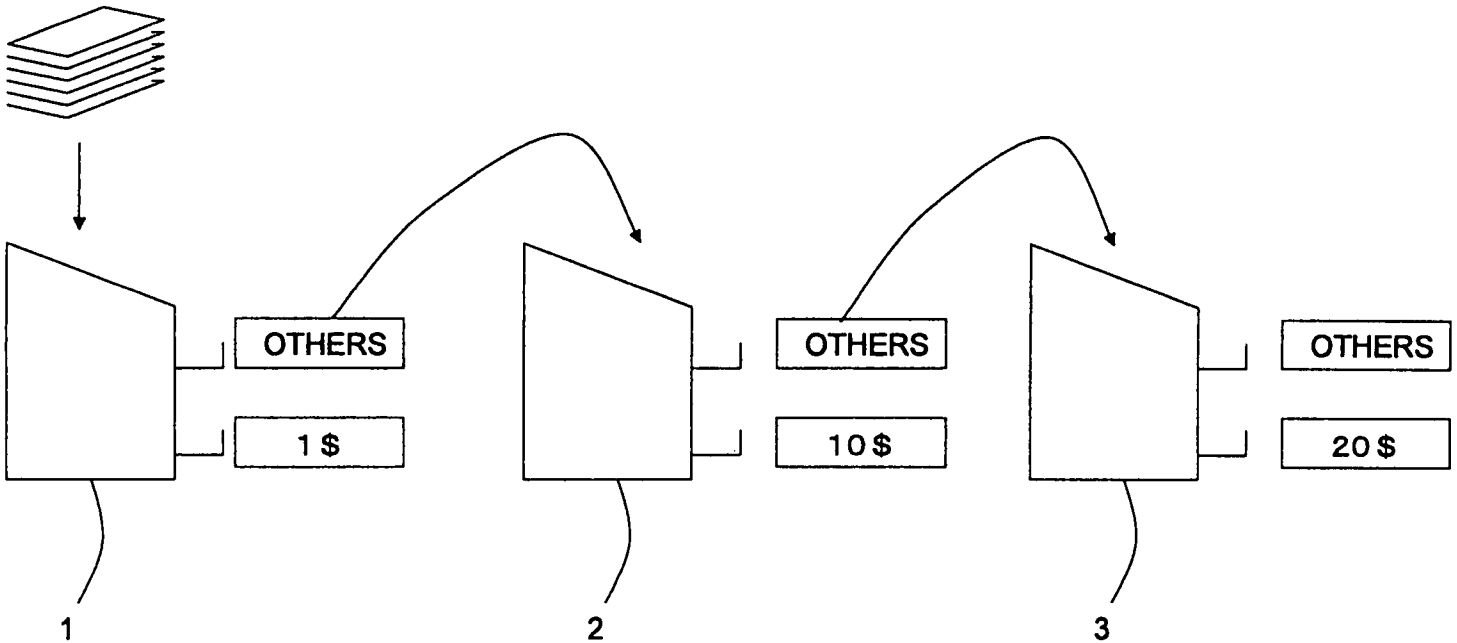
FIG. 9 is a view showing an example of the method of sorting paper sheets.
Figure 10:
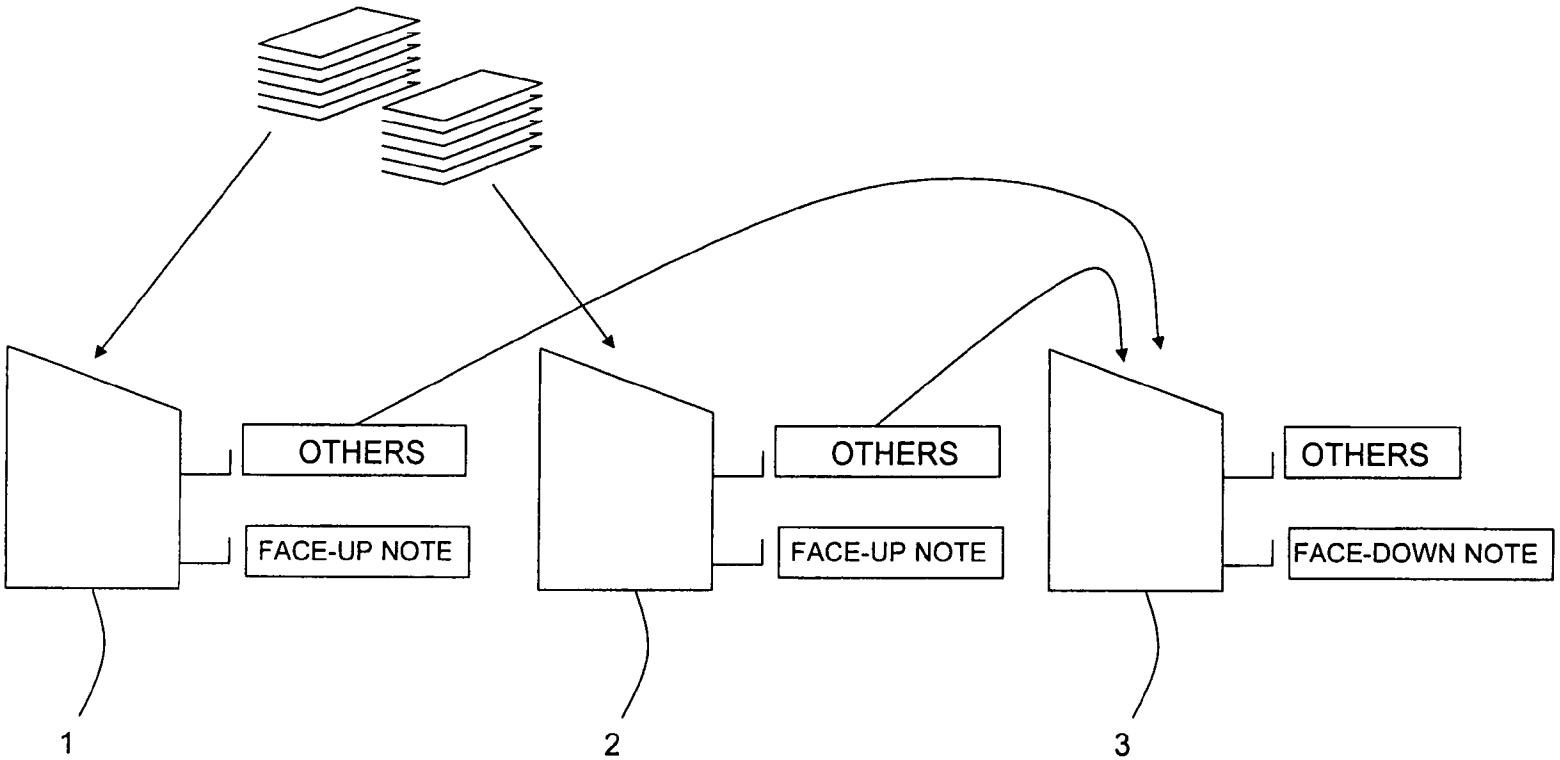
FIG. 10 is a view showing an example of the method of sorting paper sheets.
Figure 11:
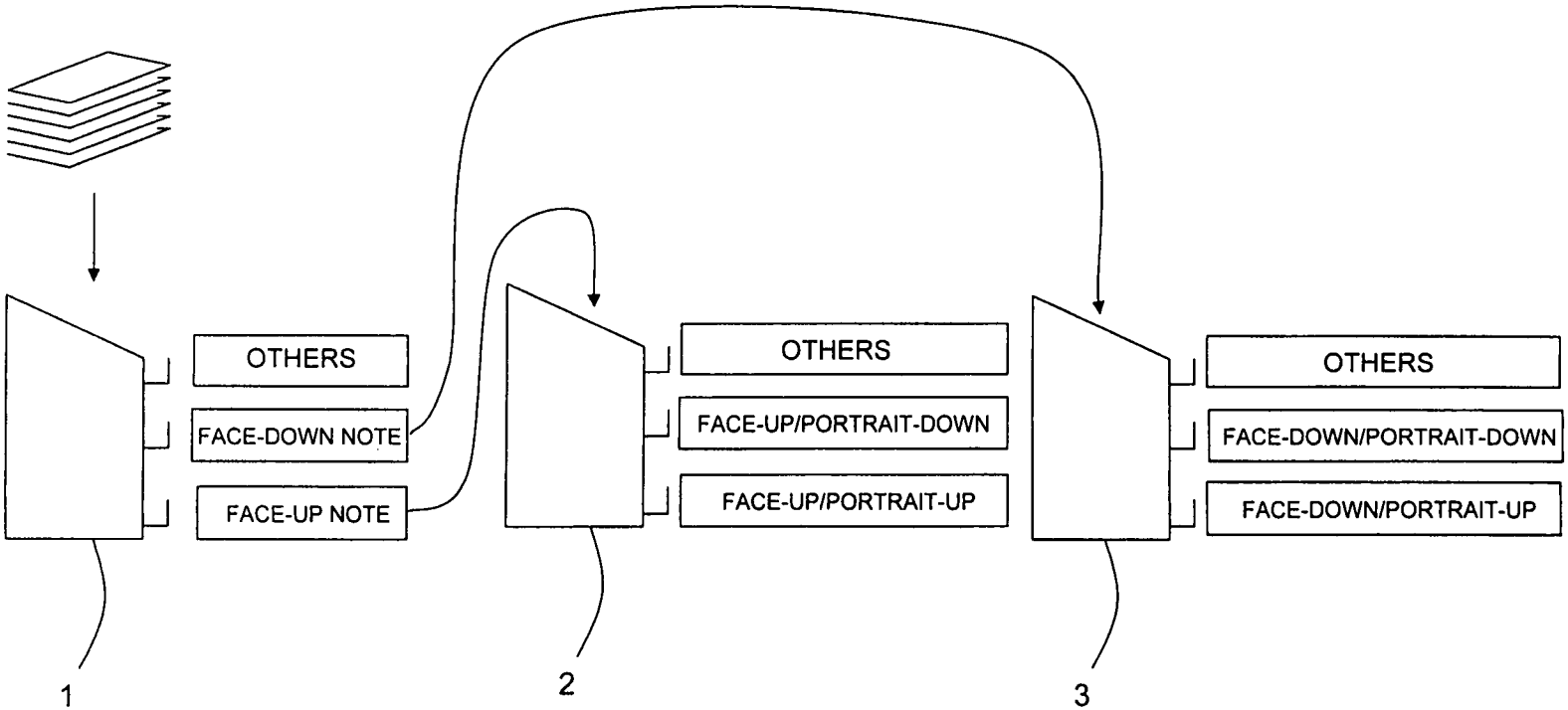
FIG. 11 is a view showing an example of the method of sorting paper sheets.

Next, a paper sheet counting method performed by the paper sheet counting system in these embodiment is described with reference to FIGS. 5 to 11. FIGS. 5 to 8 illustrate an example in which the paper sheet counting system includes two paper sheet counting apparatuses, and FIGS. 9 to 11 illustrate an example in which the paper sheet counting system includes three paper sheet counting apparatuses.

In FIGS. 5 to 11, the operation modes of the paper sheet counting apparatuses are the cooperative modes. A sorting criterion of each paper sheet counting apparatus may be set by an operator or the management apparatus, or may be set based on a sorting criterion transmitted from another paper sheet counting apparatus.

Figure 5:
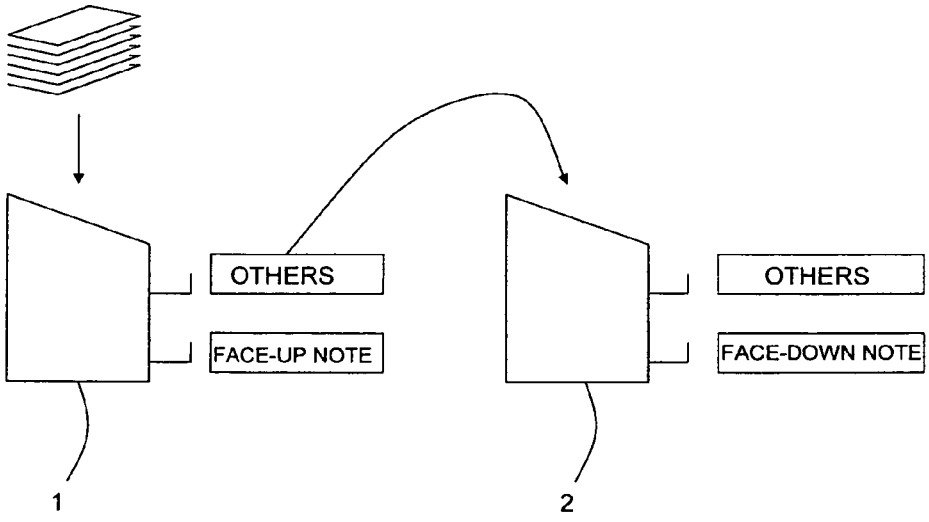
FIG. 5 is a view showing an example of a method of sorting paper sheets.

FIG. 5 shows a sorting example of paper sheets in a case where a paper sheet counting apparatus 1 and a paper sheet counting apparatus 2 have two stacking units, respectively. The two stacking units respectively correspond to the stacking unit 14 and the reject unit 15 shown in FIG. 2. Herebelow, the reject unit 15 is referred to as "stacking unit 15". A sorting criterion of the paper sheet counting apparatus 1 is "Face", while a sorting criterion of the paper sheet counting apparatus 2 is "Back". When paper sheets are supplied to the paper sheet counting apparatus 1, face-up notes are stacked in the stacking unit 14, and paper sheets other than the face-up notes are stacked in the stacking unit 15.

Then, the paper sheets in the stacking unit 15 of the paper sheet counting apparatus 1 are taken out, and then are in the paper sheet counting apparatus 2. Face-down notes are stacked in the stacking unit 14 of the paper sheet counting apparatus 2, and paper sheets other than the face-down notes, e.g., any face-up notes rejected by the paper sheet counting apparatus 1, any face-down notes rejected by the paper sheet counting apparatus 2, any unrecognizable notes, and any counterfeit notes, are stacked in the stacking unit 15. In this manner, the face-up notes and the face-down notes can be sorted.

Then, the paper sheets stacked in the stacking unit 15 of the paper sheet counting apparatus 2 are sorted again by the paper sheet counting apparatus 1 and/or the paper sheet counting apparatus 2, or are manually sorted.

Figure 6:
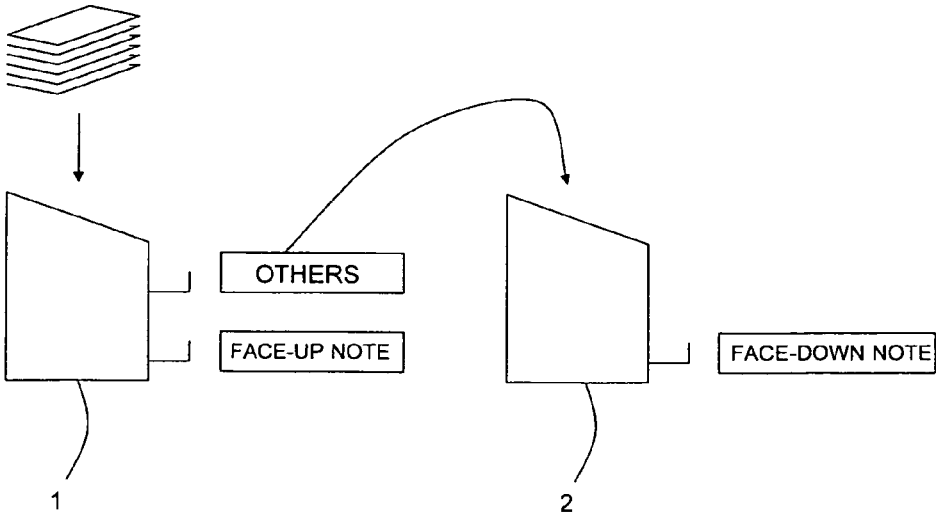
FIG. 6 is a view showing an example of the method of sorting paper sheets.

FIG. 6 shows a sorting example of paper sheets in a case where a paper sheet counting apparatus 1 includes two stacking units, and a paper sheet counting apparatus 2 includes one stacking unit. A sorting criterion of the paper sheet counting apparatus 1 is "Face", while a sorting criterion of the paper sheet counting apparatus 2 is "Back". When paper sheets are deposited in the paper sheet counting apparatus 1, face-up notes are stacked in the stacking unit 14, and paper sheets other than the face-up notes are stacked in the stacking unit 15.

Then, the paper sheets in the stacking unit 15 of the paper sheet counting apparatus 1 are taken out, and then are deposited in the paper sheet counting apparatus 2. When a paper sheet other than a face-down note is stacked in the stacking unit 14, the paper sheet counting apparatus 2 stops the operation. The paper sheet (paper sheet other than a face-down note) on top of the paper sheets stacked in the stacking unit 14 of the paper sheet counting apparatus 2 is taken out, and a restart command is given. Then, the paper sheet counting apparatus 2 restarts the operation. Thus, paper sheets other than a face-down note are taken out for each time when stacked in the stacking unit 14. In this manner, the face-up notes and the face-down notes can be sorted.

Then, the paper sheets stacked in the stacking unit 14 of the paper sheet counting apparatus 2 are sorted again by the paper sheet counting apparatus 1 and/or the paper sheet counting apparatus 2, or are manually sorted.

Figure 7:
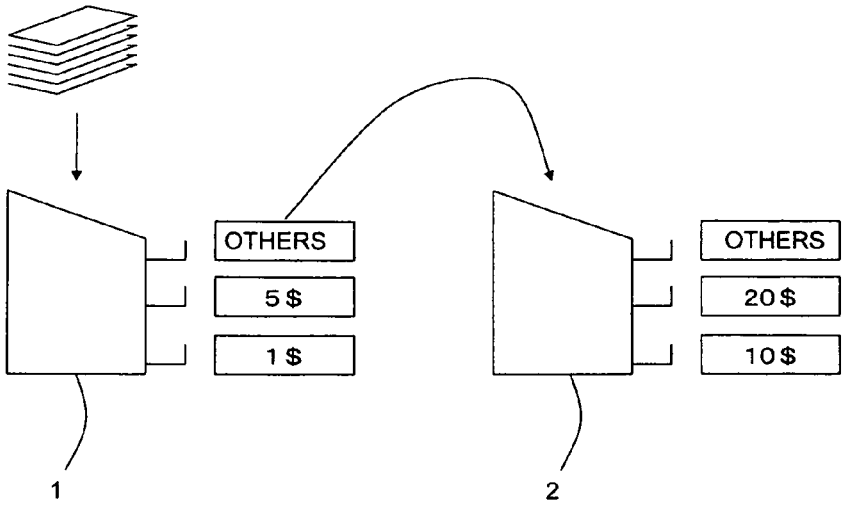
FIG. 7 is a view showing an example of the method of sorting paper sheets.

FIG. 7 shows a sorting example of paper sheets in a case where a paper sheet counting apparatus 1 and a paper sheet counting apparatus 2 have three stacking units, respectively. The three stacking units respectively correspond to the stacking unit 14, the stacking unit 16 and the stacking unit (reject unit) 15. Sorting criteria of the paper sheet counting apparatus 1 are "1$" and "5$", while sorting criteria of the paper sheet counting apparatus 2 are "10$" and "20$". When paper sheets are deposited in the paper sheet counting apparatus 1, 1$ banknotes are stacked in the stacking unit 14, 5$ banknotes are stacked in the stacking unit 16, and other paper sheets are stacked in the stacking unit 15.

Then, the paper sheets in the stacking unit 15 of the paper sheet counting apparatus 1 are taken out, and are deposited in the paper sheet counting apparatus 2. 10$ banknotes are stacked in the stacking unit 14 of the paper sheet counting apparatus 2, 20$ banknotes are stacked in the stacking unit 16, and other paper sheets are stacked in the stacking unit 15. In this manner, the 1$ banknotes, the 5$ banknotes, the 10$ banknotes and the 20$ banknotes can be sorted.

Figure 8:
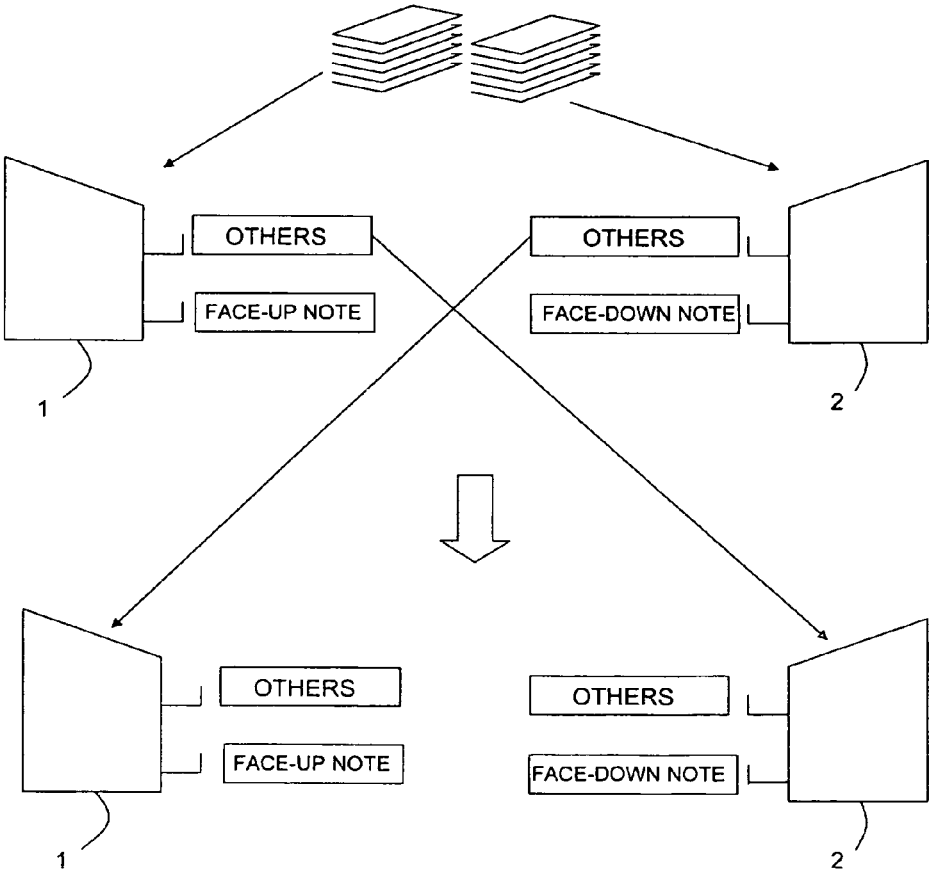
FIG. 8 is a view showing an example of the method of sorting paper sheets.

FIG. 8 shows a sorting example of paper sheets in a case where a paper sheet counting apparatus 1 and a paper sheet counting apparatus 2 have two stacking units, respectively. A sorting criterion of the paper sheet counting apparatus 1 is "Face", while a sorting criterion of the paper sheet counting apparatus 2 is "Back". The sorting criterion of the paper sheet counting apparatus 1 and the sorting criterion of the paper sheet counting apparatus 2 are different kinds belonging to the same category. In the example shown in FIG. 8, the paper sheet counting apparatus 1 and the paper sheet counting apparatus 2 are operated in parallel with each other (simultaneously).

A large number of paper sheets are separated into two groups. One group are deposited in the paper sheet counting apparatus 1 and the other group are deposited in the paper sheet counting apparatus 2. In the paper sheet counting apparatus 1, face-up notes are stacked in the stacking unit 14, and paper sheets other than the face-up notes are stacked in the stacking unit 15. On the other hand, in the paper sheet counting apparatus 2, face-down notes are stacked in the stacking unit 14, and paper sheets other than the face-down notes are stacked in the stacking unit 15.

Then, the paper sheets, which are taken out from the stacking unit 15 of the paper sheet counting apparatus 1, are deposited in the paper sheet counting apparatus 2. The paper sheets, which are taken out from the stacking unit 15 of the paper sheet counting apparatus 2, are deposited in the paper sheet counting apparatus 1. In the paper sheet counting apparatus 1, face-up notes are stacked in the stacking unit 14, and paper sheets other than the face-up notes are stacked in the stacking unit 15. On the other hand, in the paper sheet counting apparatus 2, face-down notes are stacked in the stacking unit 14, and paper sheets other than the face-down notes are stacked in the stacking unit 15.

By operating the two paper sheet counting apparatuses in parallel with each other, the large number of paper sheets can be efficiently sorted to the face-up notes and the face-down notes.

FIG. 9 shows a sorting example of paper sheets in a case where the paper sheet counting system includes paper sheet counting apparatuses 1 to 3, and the paper sheet counting apparatuses 1 to 3 have two stacking units, respectively.

A sorting criterion of the paper sheet counting apparatus is "1$", a sorting criterion of the paper sheet counting apparatus 2 is "10$", and a sorting criterion of the paper sheet counting apparatus 3 is "20$". When paper sheets are deposited in the paper sheet counting apparatus 1, 1$ banknotes are stacked in the stacking unit 14, and other paper sheets are stacked in the stacking unit 15.

Then, the paper sheets are taken out from the stacking unit 15 of the paper sheet counting apparatus 1, and are deposited in the paper sheet counting apparatus 2. 10$ banknotes are stacked in the stacking unit 14 of the paper sheet counting apparatus 2, and other paper sheets are stacked in the stacking unit 15 thereof.

Then, the paper sheets are taken out from the stacking unit 15 of the paper sheet counting apparatus 2, and are deposited in the paper sheet counting apparatus 3. 20$ banknotes are stacked in the stacking unit 14 of the paper sheet counting apparatus 3, and other paper sheets are stacked in the stacking unit 15 thereof. In this manner, the 1$ banknotes, the 10$ banknotes and 20$ banknotes can be sorted by the three paper sheet counting apparatuses each including the two stacking units, which cooperate with each other.

When all the banknotes stacked in the stacking unit 15 of the paper sheet counting apparatus 2 are of the same denomination, it is not necessary to supply the paper sheet counting apparatus 3 with the paper sheets taken out from the stacking unit 15 of the paper sheet counting apparatus 2.

In the example shown in FIG. 9, the banknotes are sorted to the three denominations. However, when the number of the paper sheet counting apparatuses provided in the paper sheet counting system is n (n is an integer not less than three), the banknotes can be sorted to n kinds of denominations by the similar method.

FIG. 10 shows a sorting example of paper sheets in a case where the paper sheet counting system includes paper sheet counting apparatuses 1 to 3, and the paper sheet counting apparatuses 1 to 3 have two stacking units, respectively.

A sorting criterion of the paper sheet counting apparatus 1 is "Face", a sorting criterion of the paper sheet counting apparatus 2 is "Face", and a sorting criterion of the paper sheet counting apparatus 3 is "Back". The sorting criterion of the paper sheet counting apparatus 1 and the sorting criterion of the paper sheet counting apparatus 2 are the same with each other. In the example shown in FIG. 10, the paper sheet counting apparatus 1 and the paper sheet counting apparatus 2 are operated in parallel with each other (simultaneously).

A large number of paper sheets are separated into two groups. One group are deposited in the paper sheet counting apparatus 1 and the other group are deposited in the paper sheet counting apparatus 2. In the paper sheet counting apparatus 1, face-up notes are stacked in the stacking unit 14, and paper sheets other than the face-up notes are stacked in the stacking unit 15. Similarly, in the paper sheet counting apparatus 2, face-up notes are stacked in the stacking unit 14, and paper sheets other than the face-up notes are stacked in the stacking unit 15.

Then, the paper sheets are taken out from the stacking unit 15 of the paper sheet counting apparatus 1 and the stacking unit 15 of the paper sheet counting apparatus 2, and are deposited in the paper sheet counting apparatus 3. Face-down notes are stacked in the stacking unit 14 of the paper sheet counting apparatus 3, and other paper sheets are stacked in the stacking unit 15 thereof.

Since the two paper sheet counting apparatuses are operated in parallel with each other so as to sort out the face-up notes and then the one paper sheet counting apparatus is operated so as to sort out the face-down notes, the large number of paper sheets can be efficiently sorted to the face-p notes and the face-down notes.

FIG. 11 shows a sorting example of paper sheets in a case where the paper sheet counting system includes paper sheet counting apparatuses 1 to 3, and the paper sheet counting apparatuses 1 to 3 have three stacking units, respectively.

Sorting criteria of the paper sheet counting apparatus 1 are "Face" and "Back", sorting criteria of the paper sheet counting apparatus 2 are "Up" and "Down", and sorting criteria of the paper sheet counting apparatus 3 are "Up" and "Down". The sorting criteria of the paper sheet counting apparatus 2 and the sorting criteria of the paper sheet counting apparatus 3 are the same with each other. The sorting criteria of the paper sheet counting apparatus 1 differ in category from the sorting criteria of the paper sheet counting apparatus 2 and the sorting criteria of the paper sheet counting apparatus 3. In the example shown in FIG. 10, the paper sheet counting apparatus 2 and the paper sheet counting apparatus 3 are operated in parallel with each other (simultaneously).

When paper sheets are supplied to the paper sheet counting apparatus 1, face-up notes are stacked in the stacking unit 14, face-down notes are stacked in the stacking unit 16, and other paper sheets are stacked in the stacking unit 15.

Then, the paper sheets in the stacking unit 14 of the paper sheet counting apparatus 1 are taken out, and are supplied to the paper sheet counting apparatus 2. Similarly, the paper sheets in the stacking unit 16 of the paper sheet counting apparatus 1 are taken out, and are supplied to the paper sheet counting apparatus 3. The face-up and portrait-up notes are stacked in the stacking unit 14 of the paper sheet counting apparatus 2, the face-up and portrait-down notes are stacked in the stacking unit 16, and other paper sheets are stacked in the stacking unit 15. On the other hand, the face-down and portrait-up notes are stacked in the stacking unit 14 of the paper sheet counting apparatus 3, the face-down and portrait-down notes are stacked in the stacking unit 16, and other paper sheets are stacked in the stacking unit 15.

Since the two paper sheet counting apparatus whose sorting criteria are the same are operated in parallel with each other, the face/back and the up/down of the paper sheets can be efficiently sorted.

As described above, the paper sheet counting system in these embodiments is capable of counting paper sheets and variously sorting the same, by the plurality of paper sheet counting apparatuses which cooperate with each other in the cooperative modes. Moreover, by changing the number of the paper sheet counting apparatuses in the cooperative modes, the paper sheet counting system is capable of readily changing the number of the paper sheet counting apparatuses which cooperate with each other. Thus, in the paper sheet counting system, the paper sheet counting apparatuses whose number corresponds to a required sorting method of paper sheets can cooperate with each other. Therefore, the paper sheet counting system is excellent in flexibility and scalability.

In the above embodiments, switching of the operation modes of the paper sheet counting apparatus is performed by an operator. However, switching of the operation modes may be performed by the tallying unit 4 or the management apparatus such as a personal computer.

In addition, in the above embodiments, each of the paper sheet apparatuses communicates with the tallying unit 4. However, only one of the plurality of paper sheet counting apparatuses may communicate with the tallying unit 4, and the other paper sheet counting apparatus(es) may transmit a count result to the tallying unit 4 through the one paper sheet counting apparatus.

The present invention is not limited to the above embodiments as they are, but can be embodied by modifying the constituent elements without departing from the scope of the invention, when the present invention is carried out. Further, various inventions can be achieved by suitably combining the plurality of constituent elements disclosed in the above embodiments. For example, some of the constituent elements may be deleted from all the constituent elements shown in the embodiment. Furthermore, it is possible to suitably combine the constituent elements in the different embodiments.

The invention claimed is:

1. A paper sheet counting system comprising:

a first paper sheet counting apparatus whose operation mode can be switched between a cooperative mode and an independent mode, the first paper sheet counting apparatus including:

a first receiving unit configured to take in deposited paper sheets one by one;

at least two first stacking units configured to stack therein the paper sheets;

a first recognition unit configured to recognize and count the paper sheets;

a first transport unit configured to transport the paper sheets between the first receiving unit and the first stacking units, based on a recognition result of the first recognition unit; and a first control unit configured to make a transition between the cooperative mode and the independent mode;

a second paper sheet counting apparatus whose operation mode can be switched between a cooperative mode and an independent mode, the second paper sheet counting apparatus being capable of communicating with the first paper sheet counting apparatus, the second paper sheet counting apparatus including:

a second receiving unit configured to take in deposited paper sheets one by one;

at least one second stacking unit configured to stack therein the paper sheets;

a second recognition unit configured to recognize and count the paper sheets;

a second transport unit configured to transport the paper sheets between the second receiving unit and the second stacking unit, based on a recognition result of the second recognition unit; and a second control unit configured to make a transition between the cooperative mode and the independent mode; and a tallying unit configured to acquire count results from the first recognition unit and the second recognition unit and to tally the count results, when the first paper sheet counting apparatus and the second paper sheet counting apparatus are in the cooperative modes.

2. The paper sheet counting system according to claim 1, wherein:

the first transport unit is configured to transport and sort the paper sheets into the respective first stacking units, based on the recognition result and a first sorting criterion; and the second transport unit is configured to transport the paper sheets based on the recognition result and a second sorting criterion different from the first sorting criterion.

3. The paper sheet counting system according to claim 2, wherein:

the first paper sheet counting apparatus is configured to transmit the first sorting criterion to the second paper sheet counting apparatus; and the second paper sheet counting apparatus is configured to set the second sorting criterion based on the transmitted first sorting criterion.

4. The paper sheet counting system according to claim 2, wherein:

the first paper sheet counting apparatus is configured to set the first sorting criterion based on a kind of the paper sheet that is firstly recognized by the first recognition unit.

5. The paper sheet counting system according to claim 1, further comprising a management apparatus configured to switch the operation modes of the respective first paper sheet counting apparatus and the second paper sheet counting apparatus between the cooperative modes and the independent modes.

6. The paper sheet counting system according to claim 1, further comprising third to n-th (n is an integer not less than three) paper sheet counting apparatuses whose operation modes can be switched between the cooperative modes and the independent modes, each of the paper sheet counting apparatuses including:

a receiving unit configured to take in deposited paper sheets one by one;

at least two stacking units configured to stack therein the paper sheets;

a recognition unit configured to recognize and count the paper sheets; and a transport unit configured to transport the paper sheets between the receiving unit and the stacking units, based on a recognition result of the recognition unit;

wherein the tallying unit is configured to acquire count results from the recognition units of the paper sheet counting apparatus in the cooperative modes, among the first to n-th paper sheet counting apparatuses, and to tally the count results.

7. A paper sheet counting method using:

a first paper sheet counting apparatus whose operation mode can be switched between a cooperative mode and an independent mode, the first paper sheet counting apparatus including:

a first receiving unit configured to take in deposited paper sheets one by one;

at least two first stacking units configured to stack therein the paper sheets;

a first recognition unit configured to recognize and count the paper sheets; and a first transport unit configured to transport the paper sheets between the first receiving unit and the first stacking units, based on a recognition result of the first recognition unit;

a second paper sheet counting apparatus whose operation mode can be switched between a cooperative mode and an independent mode, the second paper sheet counting apparatus being capable of communicating with the first paper sheet counting apparatus, the second paper sheet counting apparatus including:

a second receiving unit configured to take in deposited paper sheets one by one;

at least one second stacking unit configured to stack therein the paper sheets;

a second recognition unit configured to recognize and count the paper sheets; and a second transport unit configured to transport the paper sheets between the second receiving unit and the second stacking unit, based on a recognition result of the second recognition unit; and a tallying unit configured to tally count results;

wherein, when the first paper sheet counting apparatus and the second paper sheet counting apparatus are in the cooperative modes, the first paper sheet counting apparatus and the second paper sheet counting apparatus transmit a count result by the first recognition unit and a count result by the second recognition unit to the tallying unit, and the tallying unit performs the tallying operation by using the transmitted count results.

8. The paper sheet counting method according to claim 7, wherein when the first paper sheet counting apparatus and the second paper sheet counting apparatus are in the cooperative modes, the first paper sheet counting apparatus transports and sorts the paper sheets into the first stacking units based on a recognition result of the first recognition unit and a first sorting criterion, and the second paper sheet counting apparatus transports the paper sheets to the second stacking unit based on a recognition result of the second recognition unit and a second sorting criterion; and the first sorting criterion and the second sorting criterion are criteria for sorting the paper sheets of different kinds, belonging to a same category.

9. The paper sheet counting method according to claim 7, wherein:

the second paper sheet counting apparatus has two or more of the second stacking units; and when the first paper sheet counting apparatus and the second paper sheet counting apparatus are in the cooperative modes, the first paper sheet counting apparatus transports and sorts the paper sheets into the first stacking units, based on a recognition result of the first recognition unit and a predetermined sorting criterion, and the second paper sheet counting apparatus transports and sorts the paper sheets into the second stacking units, based on a recognition result of the second recognition unit and the predetermined sorting criterion.

10. The paper sheet counting method according to claim 9, wherein after the first paper sheet counting apparatus and the second paper sheet counting apparatus have finished the recognition and the counting of all the paper sheets received therein, the tallying unit acquires count results from the first recognition unit and the second recognition unit and tallies the count results.

11. The paper sheet counting method according to claim 7, further comprising transmitting a sorting criterion set in the first paper sheet counting apparatus to the second paper sheet counting apparatus, wherein the second paper sheet counting apparatus starts the recognition and the counting of the paper sheets, upon the notification of the sorting criterion.

12. The paper sheet counting method according to claim 11, wherein the first paper sheet counting apparatus sets a kind of a paper sheet that is firstly recognized during a sorting criterion, and notifies the second paper sheet counting apparatus of the set sorting criterion.

* * * * *